US005488289A

United States Patent [19]

Yeung

[11] Patent Number: 5,488,289

[45] Date of Patent: Jan. 30, 1996

[54] VOLTAGE TO CURRENT CONVERTER HAVING FEEDBACK FOR PROVIDING AN EXPONENTIAL CURRENT OUTPUT

[75] Inventor: Pak-Ho Yeung, San Jose, Calif.

[73] Assignee: National Semiconductor Corp., Del.

[21] Appl. No.: 154,180

[22] Filed: Nov. 18, 1993

[51] Int. Cl.[6] ..... G05F 3/04; G05F 3/16; G06G 7/10; G06G 7/12

[52] U.S. Cl. ..... 323/312; 323/315; 327/346; 327/538

[58] Field of Search ..... 323/282, 285, 323/312, 315, 316; 327/103, 346, 363, 535, 538, 540; 330/254, 257, 259, 270, 288, 290

[56] References Cited

U.S. PATENT DOCUMENTS

| | | | |
|---|---|---|---|
| 4,415,820 | 11/1983 | Zogg | 307/491 |
| 4,876,499 | 10/1989 | Anderson et al. | 323/312 |
| 5,030,924 | 7/1991 | Fritz | 330/256 |
| 5,097,489 | 3/1992 | Tucci | 375/120 |
| 5,162,678 | 11/1992 | Yamasaki | 307/491 |
| 5,278,518 | 1/1994 | Debroux | 307/279 |
| 5,428,359 | 6/1995 | Koblitz et al. | 323/315 |
| 5,432,389 | 7/1995 | Bader et al. | 327/538 |

OTHER PUBLICATIONS

William D. Llewellyn, et al., High–Speed Data Recovery (WAM 1.1: A 33 Mb/s Data Synchronizing Phase–Locked–Loop Circuit, presented on Feb. 17, 1988 at the IEEE International Solid–States Circuit Conference.

National Semiconductor Mass Storage Handbook, 1989, pp. 2–29 through 2–63.

Beomsup Kim, High Speed Clock Recovery in VLSI Using Hybrid Analog/Digital Techniques, Memo #UCB/ERL M90/50, Jun. 6, 1990, Elect. Research Lab., UC, Berkeley (particularly p. 81).

*Primary Examiner*—Matthew V. Nguyen
*Attorney, Agent, or Firm*—Limbach & Limbach

[57] ABSTRACT

A voltage to current converter which exhibits a well-defined substantially exponential voltage-current characteristic. First and second input bipolar transistors of the voltage to current converter each have an emitter, a base, and a collector. The first and second input bipolar transistors are coupled at their emitters, and may be biased with a predetermined constant current source, and they accept a selectable differential input voltage at their bases. A reference current source is connected to the collector of the first input bipolar transistor, and all output current source is connected to the collector of the second input bipolar transistor. A feedback element, having a gain, is connected between the coupled emitters and the collector of the first input bipolar transistor. The feedback element senses a voltage at the collector of the first input bipolar transistor and regulates a voltage at the coupled emitters to maintain a constant current through said first input bipolar transistor. As a result, an output current at the collector of the second input bipolar transistor varies substantially exponentially with the differential input voltage accepted at the bases of the first and second input bipolar transistors.

11 Claims, 2 Drawing Sheets

VOLTAGE TO CURRENT CONVERTER HAVING FEEDBACK FOR PROVIDING AN EXPONENTIAL CURRENT OUTPUT

TECHNICAL FIELD OF THE INVENTION

The present invention relates to voltage to current converters, and in particular, to voltage to current converters which provide substantially exponential current outputs.

BACKGROUND OF THE INVENTION

Voltage to current converters are useful for a variety of applications, including variable gain amplifiers and voltage controlled oscillators.

A first conventional voltage to current converter comprises two stacked bipolar diodes and a unity-gain connected feedback amplifier with a bipolar pnp output transistor. Linearly varying the anode-to-cathode voltage $V_d$ of such a bipolar diode stack results in an output current which varies approximately exponentially. However, the voltage-current output characteristic of such a voltage to current converter is highly susceptible to fabrication process variations. Additionally, the first conventional voltage to current converter requires external regulation of input voltage to avoid an input overdrive.

A second conventional voltage to current converter comprises a common emitter bipolar transistor pair. The bases have an input voltage applied, but the emitters are biased with a constant current. The second conventional voltage to current converter has a well-defined voltage-current characteristic. That is, the collector current is strictly a function of input voltage and bias current. However, it provides a hyperbolic tangent-type output characteristic which only approximates a desired substantially exponential output characteristic. Furthermore, the hyperbolic tangent-type output characteristic approximates an exponential output characteristic for only a limited range of input voltage levels.

SUMMARY OF THE INVENTION

The present invention provides a voltage to current converter which exhibits a well-defined substantially exponential voltage-current characteristic. The voltage to current converter comprises first and second input bipolar transistors, each having an emitter, a base, and a collector. The first and second input bipolar transistors are coupled at their emitters, and they accept a selectable differential input voltage at their bases.

A reference current source is connected to the collector of the first input bipolar transistor, and an output current source, whose output current depends on the current through the second input bipolar transistor, is connected to the collector of the second input bipolar transistor.

A feedback element, is connected between the commonly-coupled emitters and the collector of the first input bipolar transistor. The feedback element senses the voltage at the collector of the first input bipolar transistor and regulates the voltage at the coupled emitters to maintain a constant current through the first input bipolar transistor. As a result, the output current at the collector of the second input bipolar transistor varies substantially exponentially with the differential input voltage accepted at the bases of the first and second input bipolar transistors.

A voltage to current converter in accordance with a preferred embodiment of the present invention clamps its current output to a level determined by a bias current connected to the coupled emitters of the first and second input bipolar transistors.

A better understanding of the features and advantages of the invention will be obtained by reference to the following detailed description and accompanying drawings which set forth an illustrative embodiment in which the principles of the invention are utilized.

DETAILED DESCRIPTION OF THE INVENTION

Figure 1:
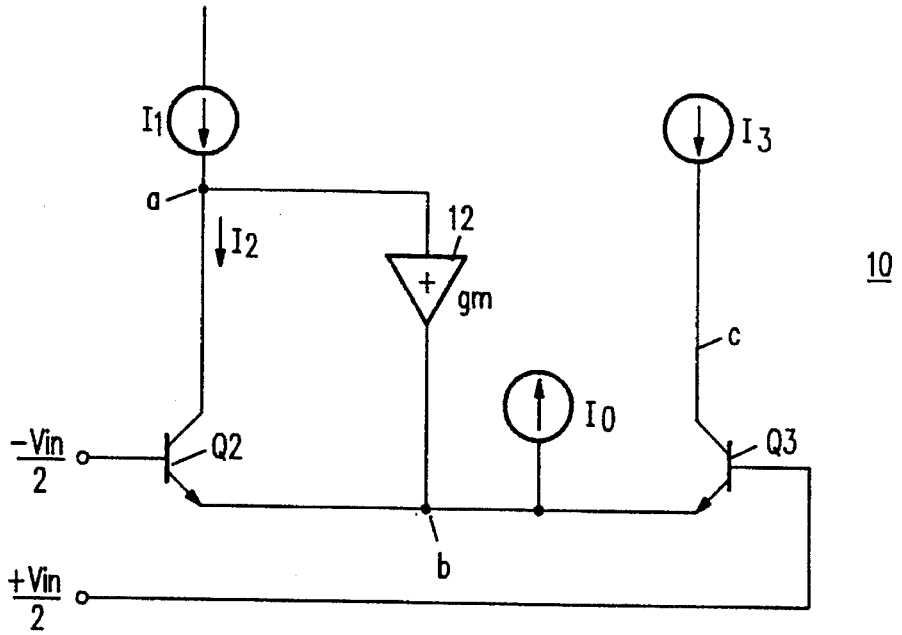
FIG. 1 is a schematic diagram illustrating a voltage to current controller circuit in accordance with the present invention.

FIG. 1 shows a voltage to current converter 10 in accordance with the present invention. Input bipolar transistors Q2 and Q3 each have an emitter, a base, and a collector and are coupled at their emitters.

The bases of input bipolar transistors Q2 and Q3 accept a selectable differential input voltage $-V_{in}/2$ and $+V_{in}/2$, respectfully. While FIG. 1 shows the base of input bipolar transistor Q2 accepting input voltage $-V_{in}/2$ and the base of input bipolar transistor Q3 accepting input voltage $+V_{in}/2$, the polarity of the differential input voltage is immaterial to proper functioning of voltage to current converter 10. Differential voltages $-V_{in}/2$ and $+V_{in}/2$ are therefore hereinafter collectively referred to as "$V_{in}$."

A reference constant current source I1 is connected to the collector of input bipolar transistor Q2, and an output current source I3 is connected to the collector of input bipolar transistor Q3. The output of output current source I3 depends on the current through input bipolar transistor Q3. A current produced by a current source is hereinafter designated identically to the current source which produced it. For example, the current produced by reference constant current source I1 will hereinafter also be designated I1.

A feedback element 12 is connected between the coupled emitters of input bipolar transistors Q2,Q3 and the collector of input bipolar transistor Q2. Feedback element 12 senses the voltage at the collector of input bipolar transistor Q2 and regulates the voltage at the coupled emitters of input bipolar transistors Q2, Q3 to maintain a constant current through input bipolar transistor Q2.

Figure 2:
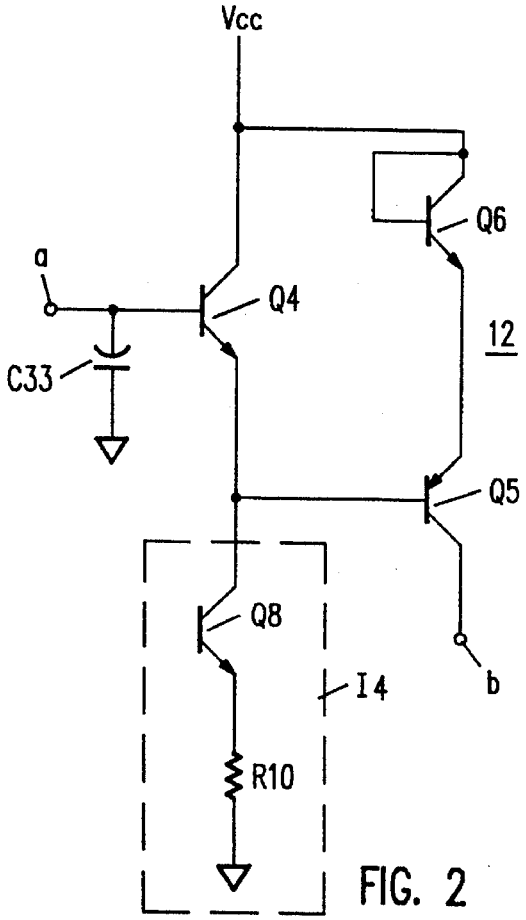
FIG. 2 is a detailed schematic diagram illustrating the feedback element of FIG. 1.

FIG. 2 is a detailed schematic diagram of a feedback element 12. Terminals a and b of FIGS. 1 and 2 provide a reference for matching the structures shown in each of the figures.

Referring to FIG. 2, the collector of a first feedback element transistor Q5 is connected to the coupled emitters of input bipolar transistors Q2, Q3. First feedback element transistor Q5 is a pnp-type transistor. Q5 must be a pnp-type transistor so that its emitter voltage is kept constant.

A second feedback element transistor Q6 has its emitter connected to the emitter of first feedback element transistor Q5. The collector and the base of second feedback element transistor Q6 is connected to a power supply.

A third feedback element transistor Q4 has its collector connected to the collector and base of second feedback element transistor Q6. The emitter of third feedback element transistor Q4 is connected to the base of the first feedback element transistor Q5.

The emitter of third feedback element transistor Q4 is further connected to a feedback element current source I4. Feedback element current source I4 serves as a biasing current source for third feedback element transistor Q4. Feedback current source I4 comprises a feedback current source transistor Q8 connected to ground via a feedback current resistor R10. Those skilled in the art will appreciate that feedback current source transistor Q8 must be externally driven by any conventional current biasing circuit (not shown).

The functioning of feedback element 12 may be appreciated by examining what occurs when a small positive voltage $V_{in}$ is applied to the bases of first and second input bipolar transistors Q2, Q3 (for example, $-V_{in}/2$ is applied to the base of Q2 and $+V_{in}/2$ is applied to the base of Q3). The applied voltage causes the current I2 through first input bipolar transistor Q2 to be reduced. This reduction in current through first input bipolar transistor Q2 in turn raises the voltage at terminal a of FIG. 1, reducing the current through first and second feedback element transistors Q5, Q6. Since I1 is a constant current, and since I1 must equal I2 and I1+I2 must equal I3, the common emitter voltage of transistors Q2,Q3 must drop slightly in response to the small positive differential voltage applied to the bases of transistors Q2,Q3.

The collector current $I_c$ of a transistor may be generally expressed as set forth in Equation (1):

$$I_c = I_s \times \exp\left(\frac{V_{be}}{V_T}\right) \tag{1}$$

where $I_s$ represents transistor parameters which vary from fabrication to fabrication; $V_{be}$ represents the voltage difference between the base and the emitter; and $V_T$ represents a thermal voltage which depends on temperature. Given Equation (1), and since the $V_{be}$ for the first input bipolar transistor Q2 is the negative of $V_{be}$ for the second input bipolar transistor Q3, $$\frac{I3}{I2} = \exp\left(\frac{V_{in}}{V_T}\right). \tag{2}$$

Furthermore, since I2=I1, $$I3 = I1 \times \exp\left(\frac{V_{in}}{V_T}\right). \tag{3}$$

Since I1 is constant, equation (3) shows that, in accordance with the present invention, voltage to current converter 10 provides a well-defined substantially exponential voltage-current characteristic that does not depend on any specific fabrication-dependent variable transistor parameters.

Those skilled in the art will appreciate that voltage to current converter 10 will provide a substantially exponential voltage-current characteristic even if feedback current source I4 consisted of feedback current resistor R10 alone, without feedback current source transistor Q8. However, feedback current source transistor Q8 makes the biasing of feedback element transistor Q4 independent of $V_{cc}$, and thus produces the desirable result that the power dissipated by feedback current source resistor R10 is independent of $V_{cc}$.

Those skilled in the art will further appreciate that if transistor Q5 has a sufficiently high gain, voltage to current converter 10 will provide a substantially exponential voltage-current characteristic even if feedback element transistor Q4 and feedback current source I4, and preferably also feedback element transistor Q6, were altogether eliminated from feedback element 12.

A bias current source $I_0$ may be provided to the coupled emitters of input bipolar transistors Q2, Q3 to clamp I3 to I0. That is, for a large increase in $V_{in}$, the coupled emitters voltage of first and second input bipolar transistors Q2, Q3 will increase, instead of decreasing as in the case of a small increase in $V_{in}$, so that I3 equals I0 and at the same time I2 shuts off.

Figure 3:
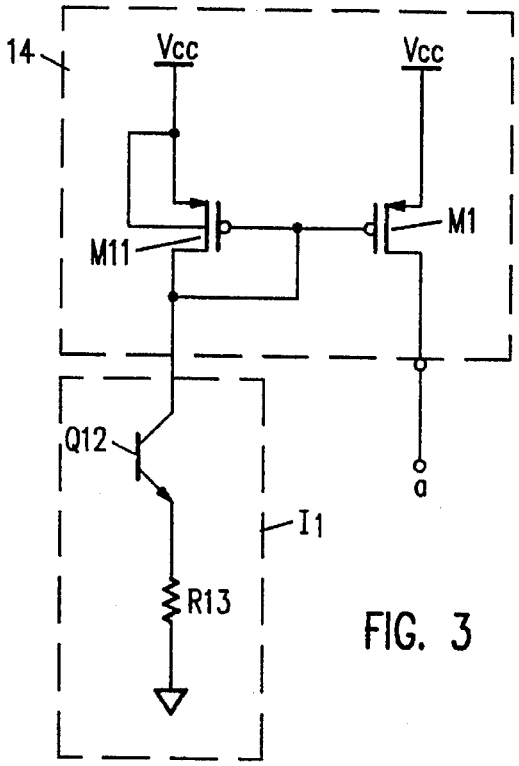
FIG. 3 is a detailed schematic diagram illustrating the input current source of FIG. 1.

FIG. 3 is a detailed schematic of input current source I1 of FIG. 1. As shown in FIG. 3, input current source I1 comprises a current mirror 14 that includes p-channel transistors M1 and M11 where NPN transistor Q12 and resistor R13 provide means for "programming" the current mirror 14. Those skilled in the art will appreciate that feedback current source transistor Q12 must be externally driven by any conventional current biasing circuit (not shown). Furthermore, such a current mirror "program" technique is known in the art, and is described, for example, on p. 88 of The Art Of Electronics (Second Edition), Horowitz and Hill (1989).

It is of particular advantage for the transistors M1,M11 of the current mirror to be MOS transistors so that when an out-of-range input voltage $V_{in}$ is applied to the bases of input bipolar transistors Q2, Q3, such that I3 would be equal to $I_0$, M1 may be shut off at its drain to limit the input current. Furthermore, MOS transistors require only a relatively short time to recover from such a shutoff condition.

Figure 4:
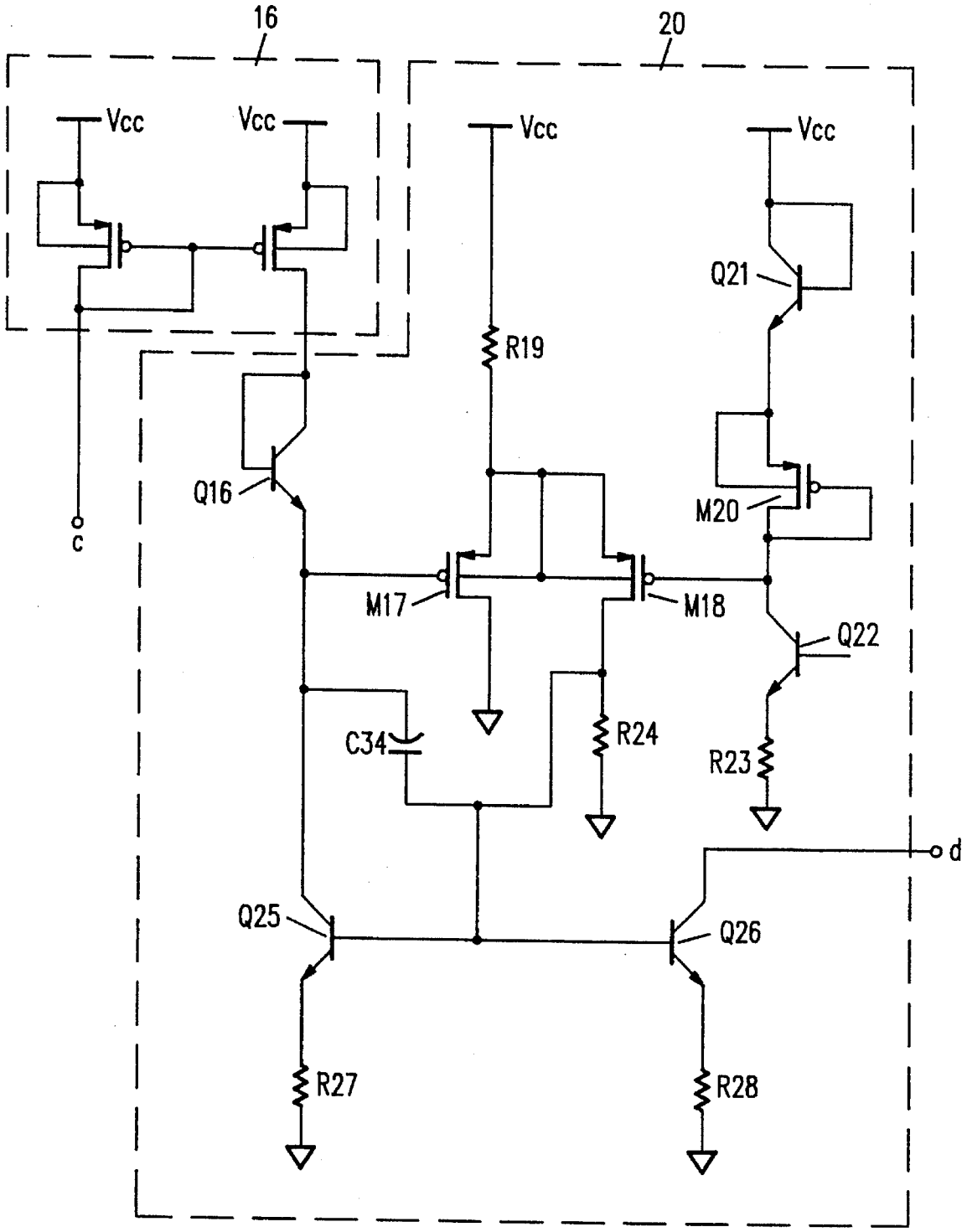
FIG. 4 is a detailed schematic diagram illustrating an output current mirror and a level translator which may be used in conjunction with the FIG. 1 voltage to current controller circuit.

As shown in FIG. 4, output current source I3 may be a current mirror 16. Furthermore, a level translator 20 may be provided to improve the output voltage range of operation of voltage to current converter 10. Level translators are well-known to those skilled in the art. For example, as discussed on p. 572 of The Art of Electronics (Second Edition), level translators are used to interface between logic families. Current mirror 16 and level translator 20 may be used in conjunction with voltage to current controller 10 by replacing I3 with current mirror 16 and level translator 20 at terminal c and receiving an output current at terminal d of FIG. 4.

It should be understood that various alternatives to the embodiments of the invention described herein may be employed in practicing the invention. It is intended that the following claims define the scope of the invention and that methods and apparatus within the scope of these claims and their equivalents be covered thereby.

What is claimed is:

1. A voltage to current converter comprising:

first and second input bipolar transistors, each having an emitter, a base, and a collector, said first and second input bipolar transistors being coupled at said emitters and accepting a selectable differential input voltage at said bases;

a reference current source connected to said collector of said first input bipolar transistor;

an output current source connected to said collector of said second input bipolar transistor, an output current of said output current source dependent on a current through said second input bipolar transistor; and a feedback element connected between said coupled emitters and said collector of said first input bipolar transistor, and that senses a voltage at said collector of said first input bipolar transistor and regulates a voltage at said coupled emitters to maintain a constant current through said first input bipolar transistor whereby an output current at said collector of said second input bipolar transistor varies exponentially with said differential input voltage.

2. A voltage to current converter as in claim 1, wherein said feedback element comprises:

a first feedback element transistor having a base, a collector, and an emitter, said first feedback element transistor being a pnp-type transistor, said collector of said first feedback element transistor being connected to said coupled emitters of said first and second input bipolar transistors;

a second feedback element transistor having a base, a collector, and an emitter, said emitter of said second feedback element being connected to said emitter of said first feedback element transistor, said collector of said second feedback transistor being connected to a power supply and said base of said second feedback transistor also being connected to said power supply;

a third feedback element transistor having a base, a collector, and an emitter, said collector of said third feedback element connected to said collector of said second feedback element, said emitter of said third feedback element connected to said base of said first feedback element, and said base of said third feedback element connected to said reference current source; and a feedback element current source connected to said emitter of said third feedback element whereby said feedback element maintains a constant current through said first input bipolar transistor regardless of a value of said differential input voltage.

3. A voltage to current converter as in claim 2, wherein said feedback element current source comprises a feedback element current source resistor having a first end and a second end, said first end coupled to said base of said first feedback element transistor and said second end connected to ground.

4. A voltage to current converter as in claim 3, wherein said feedback element current source further comprises:

a feedback element current source transistor, having a base, a collector, and an emitter, interposed between said feedback element current source resistor and said base of said first feedback element transistor, said emitter of said feedback element current source transistor connected to said first end of said feedback element current source resistor and said collector of said reference current source connected to said base of said first feedback element transistor.

5. A voltage to current converter as in claim 1, further comprising:

a biasing current source, for producing a predetermined current, connected to said coupled emitters whereby said output current at said collector of said second input bipolar transistor is limited to said predetermined current.

6. A voltage to current converter as in claim 1, wherein said reference current source is a current mirror that includes a first reference current source MOS transistor and a second reference current source MOS transistor, said first and second reference current MOS transistors having a gate, a drain, and a source, said second reference current source MOS transistor connected to said collector of said first input bipolar transistor.

7. A voltage to current converter as in claim 6, wherein said first and second reference current source MOS transistors are of p-channel type.

8. A voltage to current converter as in claim 6, wherein said gate and said drain of said first reference current source MOS transistor are coupled to ground through a resistor.

9. A voltage to current converter as in claim 8, wherein a third reference current source bipolar transistor is interposed between said first reference current source MOS transistor and said resistor, said third reference current source bipolar transistor having a base, a collector, and an emitter, said gate and said drain of said first reference current source MOS transistor connected to said collector of said third reference current source bipolar transistor and said emitter of said third reference current source bipolar transistor connected to said resistor.

10. A voltage to current converter as in claim 1, further comprising:

a level translator, said level translator having an input and an output, said input of said level translator connected to said collector of said second input bipolar transistor whereby a level translator output current at said output of said level translator varies substantially exponentially with said differential voltage at said bases of said first and second input bipolar transistors.

11. A voltage to current converter as in claim wherein said output current source comprises a current mirror.

* * * * *

UNITED STATES PATENT AND TRADEMARK OFFICE

CERTIFICATE OF CORRECTION

PATENT NO. : 5,488,289

DATED : January 30, 1996

INVENTOR(S) : Pak-Ho Yeung

It is certified that error appears in the above-indentified patent and that said Letters Patent is hereby corrected as shown below:

IN THE CLAIMS:

In Col. 6, line 43, please insert --1-- after "claim".

Signed and Sealed this

Thirtieth Day of April, 1996

*Attest:*

*Attesting Officer*

BRUCE LEHMAN

*Commissioner of Patents and Trademarks*